United States Patent [19]

Schöberle et al.

[11] Patent Number: 4,565,613

[45] Date of Patent: Jan. 21, 1986

[54] PROCESS FOR REMOVING A LAYER OF THICK MERCURY FROM THE BOTTOM OF MERCURY-CATHODE ELECTROLYSIS CELLS AND A PROCESS FOR THE ELECTROLYSIS OF AN AQUEOUS SOLUTION OF AN ALKALI METAL HALIDE IN A MERCURY-CATHODE CELL

[75] Inventors: Robert Schöberle, Brussels, Belgium; Walter Schaffer, Hallein, Austria

[73] Assignee: Solvay & Cie, Brussels, Belgium

[21] Appl. No.: 622,223

[22] Filed: Jun. 19, 1984

[30] Foreign Application Priority Data

Jun. 20, 1983 [FR] France ..... 83 10284

[51] Int. Cl.[4] ..... C25G 1/40

[52] U.S. Cl. ..... 204/99

[58] Field of Search ..... 204/99, 219–221, 204/250

[56] References Cited

U.S. PATENT DOCUMENTS

| | | | |
|---|---|---|---|
| 679,476 | 7/1901 | Kelley | 204/221 |
| 1,009,133 | 11/1911 | Croston | 204/221 |
| 3,321,388 | 5/1967 | Ueda et al. | 204/98 |
| 3,905,880 | 9/1975 | Lee et al. | 204/99 |
| 4,303,491 | 12/1981 | Ferrari et al. | 204/220 |

*Primary Examiner*—R. L. Andrews

*Attorney, Agent, or Firm*—Robert E. Burns; Emmanuel J. Lobato; Bruce L. Adams

[57] ABSTRACT

To remove a layer of thick mercury from the bottom of electrolysis cells having a cathode formed by a film of mercury flowing over the bottom, a scraper is moved in the mercury film in a controlled manner to leave continuously a residual film of thick mercury of predetermined thickness adhering to the bottom. The process applies to mercury-cathode cells for the electrolysis of aqueous solutions of sodium chloride.

11 Claims, No Drawings

PROCESS FOR REMOVING A LAYER OF THICK MERCURY FROM THE BOTTOM OF MERCURY-CATHODE ELECTROLYSIS CELLS AND A PROCESS FOR THE ELECTROLYSIS OF AN AQUEOUS SOLUTION OF AN ALKALI METAL HALIDE IN A MERCURY-CATHODE CELL

FIELD OF INVENTION

The present invention relates to a process for removing a layer of thick mercury from the bottom or base-plate of electrolysis cells having a cathode formed by a film of mercury flowing over the bottom.

BACKGROUND OF THE INVENTION

A major difficulty which is encountered in the use of mercury-cathode electrolysis cells, such as those widely employed for the electrolysis of aqueous solutions of an alkali metal halide, for example sodium chloride, lies in the untimely and uncontrolled formation of a viscous accumulation adhering to the bottom of the cells and usually called "thick mercury" or "mercury butter".

The formation of these accumulations of thick mercury adhering to the bottom of the electrolysis cells interferes with the flow of the mercury film forming the cathode and consequently demands continuous surveillance of the position of the anodes and adjustment, at regular intervals, of their distance from the mercury film, to avoid the formation of chance short circuits. The gradual accumulation of thlck mercury on the bottom of the cells requires, moreover, that the bottom is cleaned at regular intervals and for this purpose it has been proposed to move a scraper over the bottom, at regular intervals, to detach from it the agglomerates of thick mercury (Belgian Patent No. 881,995 to Montedison SpA ; Central Patents Index, Abstracts Journal, London (Great Britain), Abstract 04648 W/03 : Japanese Patent Application 49,098,798 to Mitsubishi Chem.; ibid., Abstract 91,735 X/49 : Japanese Patent Application No. 76,041,040 to Mitsubishi Chem.). In these known processes, the movement of the scraper over the bottom of the cell is controlled so as to remove on each occasion all of the thick mercury which forms there.

SUMMARY OF THE INVENTION

It has now been found that it was possible to improve the operation of mercury-cathode electrolysis cells and, in particular, to reduce the frequency of the adjustment of the anode position, by a suitable control of the movement of the scraper in the cell.

To this end, the invention relates to a process for removing a layer of thick mercury from the bottom or base-plate of electrolysis cells the cathode of which is a film of mercury flowing over the bottom, according to which a scraper is moved in the mercury film, the movement of the scraper being controlled so as to leave continuously a residual film of thick mercury of a predetermined thickness adhering to the bottom.

In the process according to the invention, the movement of the scraper must be controlled to detach only the upper part of the agglomerates of thick mercury without tampering with the abovementioned residual film which must be completely immersed in the film of mercury. The optimum thickness of the residual film of thick mercury to be maintained on the bottom depends on various factors which are related to the design of the electrolysis cell and to its method of operation, among which may be mentioned in particular the length of the cell, the slope of the bottom, the anode profile, the thickness of the mercury film, the distance separating the anodes from the cathode and the electrolysis current density. This optimum thickness may easily be determined, for each particular case, by routine investigation. As a general rule, in the case of cells with a moderate slope (for example of the order of 1.5 to 15 mm per meter run length, and more particularly from 6 to 10 mm per meter), in which the mercury film has a mean thickness of between 2 and 5 mm, suitable thicknesses of the residual film of thick mercury are those of at least 0.04 mm, and more particularly those between 0.05 and 2.5 mm, the thicknesses of between 0.15 mm and 1.5 mm being especially advantageous.

Appropriate control of the movement of the scraper in the film of mercury may be effected by any suitable means. For this purpose, for example, it is possible to make the scraper slide on guides which are solidly fixed to the bottom and which continuously keep the scraper separated from the bottom by a distance which is equal to the required thickness of the residual film of thick mercury.

DESCRIPTION OF PREFERRED EMBODIMENT

In a preferred embodiment of the invention, use is made, as the scraper, of the forward end of a flexible band the specific gravity of which is lower than that of mercury and which is designed to be partly immersed in the mercury film, so that its lower face is separated from the bottom by a distance equal to the required thickness of the residual film of thick mercury. In this embodiment of the invention, the flexible band is introduced into the cell and, inside it, is pushed into the mercury film in parallel with the bottom. While the band is thus pushed, from behind, in the cell, the front edge of its forward end detaches from the bottom a surface layer of the accumulations of thick mercury.

In this embodiment of the invention, the choice of the thickness of the band is determined by the need to give it both an adequate stiffness to enable it to be moved in the mercury film by being pushed from behind, and sufficient flexibility to enable it to pass under the anodes without damaging them. The choice of the optimum thickness of the band depends on various parameters, particularly the material of which the band is made, its width and its length, which is itself related to the length of the cell, and it can be determined in each particular case by routine investigation. For example, in the case of a band approximately 10 to 20 m in length, made of an organic polymer such as polyethylene, polypropylene or, preferably, a fluorinated polymer, good results are obtained by giving the band a thickness which is substantially between 2 and 5 mm. The abovementioned forward end of the band, which serves as the scraper, may, if appropriate, be strengthened or stiffened, for example by being given a thickness which is greater than that of the following part of the band, and its front edge may be bevelled. In an alternative form of embodiment, the forward end of the band, which serves as the scraper, is a paddle which has a front edge which is transverse to the lengthwise axis of the band and two lateral edges arranged slantwise relative to this axis so as to be separated from it towards the rear. In this alternative form of embodiment of the invention, the front edge of the paddle serves to detach the layer of thick mercury and the lateral edges serve to separate the agglomerates of thick mercury which have been detached in this way, during the movement of the band in the cell.

Use is preferably made of a band of which at least the periphery is made of an electrically non-conductive material, which makes it possible to maintain a voltage across the cell while the band is moved in the mercury inside it; the material employed for this purpose may, for example, be a fluorinated polymer such as polyvinylidene fluoride or polytetrafluoroethylene. The maintenance of the separation of the flexible band relative to the bottom may be produced by sliding the band against the lower face of the anodes in the cell or against fixed guides. In an alternative form, the maintenance of this separation may be produced by a suitable control of its specific gravity, for example by incorporating in it a core made of a dense material, or by controlled electromagnetic attraction towards the bottom, by incorporating in it a core made of a ferromagnetic material, usually iron powder.

When this embodiment of the invention is employed, the band is introduced at one end of the cell and is pushed in the mercury film therein, towards the opposite end of the cell. The movement of the band may take place from the upstream end towards the downstream end of the cell relative to the direction of flow of the mercury film; it is preferred, however, to make the band move from the downstream end towards the upstream end. To facilitate operation and reduce bulk, the band may advantageously be unwound in the cell from a drum arranged near one end of the cell (for example its abovementioned downstream end) and, as soon as the forward end of the band has traversed the whole cell, moved in the reverse direction by rewinding it on the drum. In this embodiment of the process, the alternating successive movements of the band at regular intervals may be automated by coupling the drum to a motor the operation of which is subject to a controlling device. The latter may be programmed so as to start the drum motor automatically at predetermined time intervals; in an alternative form, it may incorporate an instrument for measuring the thickness of the layer of thick mercury on the bottom and be programmed to start the drum motor automatically as soon as the thickness of this layer, measured by the measuring instrument, exceeds a predetermined critical value.

The process according to the invention has a particularly advantageous application in the case of cells with an approximately horizontal mercury cathode, which are usually employed for the electrolysis of aqueous solutions of sodium chloride, and more particularly cells of this type which are equipped with metal anodes.

All else being equal, the process according to the invention reduces the rate of formation of thick mercury and, consequently, the frequency of bottom cleaning; furthermore, it improves the uniformity of the flow of the mercury film, thereby facilitating the control of the distances separating the anodes from the cathode, reduces the frequency and the size of the adjustments in the position of the anodes relative to the cathode and makes it possible to operate with smaller distances between the anodes and the cathode.

Consequently, the invention also relates to a process for the electrolysis of an aqueous solution of an alkali metal halide, for example sodium chloride, in an electrolysis cell the cathode of which incorporates a mercury film flowing on a metal bottom, according to which an adherent film of thick mercury, of a thickness between 0.04 and 2.5 mm, is continuously maintained on the bottom.

It is generally advisable that, in the electrolysis process according to the invention, the film of thick mercury covers the whole of the bottom. Its optimum thickness depends particularly on the thickness of the flowing mercury film. The thickness of the latter is preferably between 2 and 5 mm.

The merit of the invention will become apparent from the following description of comparative tests.

In the tests which follow, electrolysis was carried out of an aqueous solution of sodium chloride in a cell with a moving mercury cathode, of the V-200 type (Solvay & Cie), described in the treatise by J. S. Sconce "Chlorine, its manufacture; properties and uses", 1962, Reinhold Publishing Corp., New York, pages 187 to 189. The cell was fitted with 180 anodes formed by horizontal strips of titanium carrying an active coating made of a mixture of ruthenium oxide and titanium oxide. The distance between the anodes and the cathode was fixed at approximately 2 mm, the flowing mercury film, forming the cathode, having a mean thickness of approximately 3 mm.

Test No. 1 (according to the invention)

To clean the bottom of the cell, the anodes were first lifted and then a flexible band made of polytetrafluoroethylene containing a steel core and having an approximate length of 16 m and a thickness of approximately 4 mm was introduced, starting from the downstream end of the cell, and was moved in the mercury film, towards the upstream end of the cell. As a result of its specific gravity and its metal core, the band remained immersed approximately 2 mm in the mercury film during its movement in the cell; as a result, it detached a surface layer of the thick mercury agglomerates present on the bottom, leaving, adhering to it, a residual film of thick mercury approximately 1 mm in thickness. After the band was withdrawn from the cell, the anodes were lowered to bring their distance from the mercury film to approximately 2 mm.

The operation of the cell required no further adjustment of the anodes during the next 3 days.

Test No. 2 (reference test)

The procedure was as in Test No. 1, but with the polytetrafluoroethylene band being replaced by a metal scraper which was employed to remove all the thick mercury present on the bottom of the cell. After the scraping, the anodes were lowered to bring their distance relative to the cathode to approximately 2 mm, as in test No. 1. During subsequent operation of the cell, new agglomerates of thick mercury reformed rapidly on the bottom, requiring two additional successive adjustments of the position of the anodes, after 6 hours' and after 24 hours' operation, respectively.

What we claim is:

1. Process for removing a layer of thick mercury from the bottom of electrolysis cells having a cathode formed by a film of mercury flowing over the bottom, according to which a scraper is moved in the mercury film, characterized in that the movement of the scraper is controlled so as to leave continuously a residual film of thick mercury of a thickness of at least 0.04 mm adhering to the bottom.

2. Process according to claim 1, characterized in that the movement of the scraper is controlled so that the thickness of the residual film of thick mercury is between 0.15 and 1.5 mm.

3. Process according to claim 1, characterized in that the scraper comprises the forward end of a flexible band the specific gravity of which is lower than that of mercury and that said band is pushed in the mercury film in a direction parallel with the bottom.

4. Process according to claim 3, characterized in that at least the periphery of said flexible band is made of an electrically non-conductive material.

5. Process according to claim 3, characterized in that the band is controlled by being made to slide on the lower face of the anodes of the cell.

6. Process according to claim 4, characterized in that said flexible band incorporates a core made of a dense material.

7. Process according to claim 6, characterized in that the flexible band incorporates a core made of a ferromagnetic material.

8. Process according to claim 3, characterized in that the flexible band is moved from the downstream end towards the upstream end of the cell relative to the direction of flow of the mercury film.

9. Process according to claim 1, characterized in that it is applied to a cell in which the bottom has a slope of between 1.5 and 15 mm per meter run length and the mercury film has a mean thickness of between 2 and 5 mm.

10. Process for the electrolysis of an aqueous solution of an alkali metal halide in an electrolysis cell the cathode of which incorporates a film of mercury flowing over a metal bottom, characterized in that an adherent film of thick mercury, of a thickness between 0.04 and 2.5 mm, is maintained continuously on the bottom.

11. Process according to claim 1, characterized that the movement of the scraper is controlled by its being made to slide on guides which are solidly fixed to the bottom of said cell and which continuously keep the scraper separated from the bottom by a distance that is equal to the thickness of the residual film of thick mercury to be left on the bottom of the cell.

* * * * *